United States Patent [19]

Bizilia

[11] 4,212,458

[45] Jul. 15, 1980

[54] FOOT HOLDING DEVICE FOR USE IN PERFORMING SIT-UP EXERCISES

[76] Inventor: George Bizilia, 226 Newbury St. #22, Boston, Mass. 02116

[21] Appl. No.: 903,873

[22] Filed: May 8, 1978

[51] Int. Cl.[3] ..... A63B 23/02

[52] U.S. Cl. ..... 272/93; 272/900

[58] Field of Search ..... 272/900, 144, 145, 109

[56] References Cited

U.S. PATENT DOCUMENTS

| | | | |
|---|---|---|---|
| 2,050,652 | 8/1936 | Fleming | 272/900 X |
| 2,425,971 | 8/1947 | Walker | 272/900 |
| 3,134,592 | 5/1964 | Sharkey | 272/900 X |
| 3,287,016 | 11/1966 | Mayer | 272/144 X |
| 4,116,434 | 9/1978 | Bernstein | 272/900 X |

FOREIGN PATENT DOCUMENTS

| | | | |
|---|---|---|---|
| 942707 | 11/1963 | United Kingdom | 272/900 |

*Primary Examiner*—Richard C. Pinkham
*Assistant Examiner*—William R. Browne

[57] ABSTRACT

A device for holding the feet of a person doing "sit-up" exercises has a U-shaped base to receive the bottom margin of a door, a head section provided with laterally spaced foot retainers and a connecting section outwardly and upwardly inclined to space the head away from the door. The head is rearwardly and upwardly inclined to provide the proper position of the feet.

5 Claims, 3 Drawing Figures

FOOT HOLDING DEVICE FOR USE IN PERFORMING SIT-UP EXERCISES

BACKGROUND REFERENCES

U.S. Pat. No. 2,425,971
U.S. Pat. No. 3,134,592

BACKGROUND OF THE INVENTION

At the present time, more and more people are becoming interested in exercising on a regular basis. One of the best indoor exercises for the abdominal area is "sit-ups". Although they may be performed without the feet being held, if the feet are restrained the body of the person exercising is held from moving relative to the floor. For that reason, devices have been proposed for holding the feet, the device in the case of U.S. Pat. No. 2,425,971 attachable to a door and in the case of U.S. Pat. No. 3,134,592 attachable to the footboard of a bed, in both cases utilizing a cross bar behind which the feet were positioned and as far as I am aware, neither proposal has been commercially accepted.

THE PRESENT INVENTION

The general objective of the present invention is to provide a device for use by a person while performing sit-ups that is easily attached to a door and provides comfortable, proper support for his feet.

In accordance with the invention, this objective is attained with a device including a U-shaped base dimensioned to be slid under and held by the bottom margin of a door, preferably secured by thumb screws, a head having laterally spaced retainers, one for each foot, and a connecting section between the head and the base outwardly and upwardly inclined from the latter and with the head rearwardly and upwardly inclined.

An important objective of the invention is to provide foot retainers that enable the feet to be comfortably held, an objective attained with each retainer a seat for the ball area of the foot and a retaining strap with its ends caught marginally of each seat, each seat rearwardly inclined to define an angle in the approximate range of from 10° to 15° ensuring foot comfort while exercising.

BRIEF DESCRIPTION OF THE DRAWINGS

A preferred embodiment of the invention is illustrated by the accompanying drawings of which.

THE PREFERRED EMBODIMENT OF THE INVENTION

Figure 1:
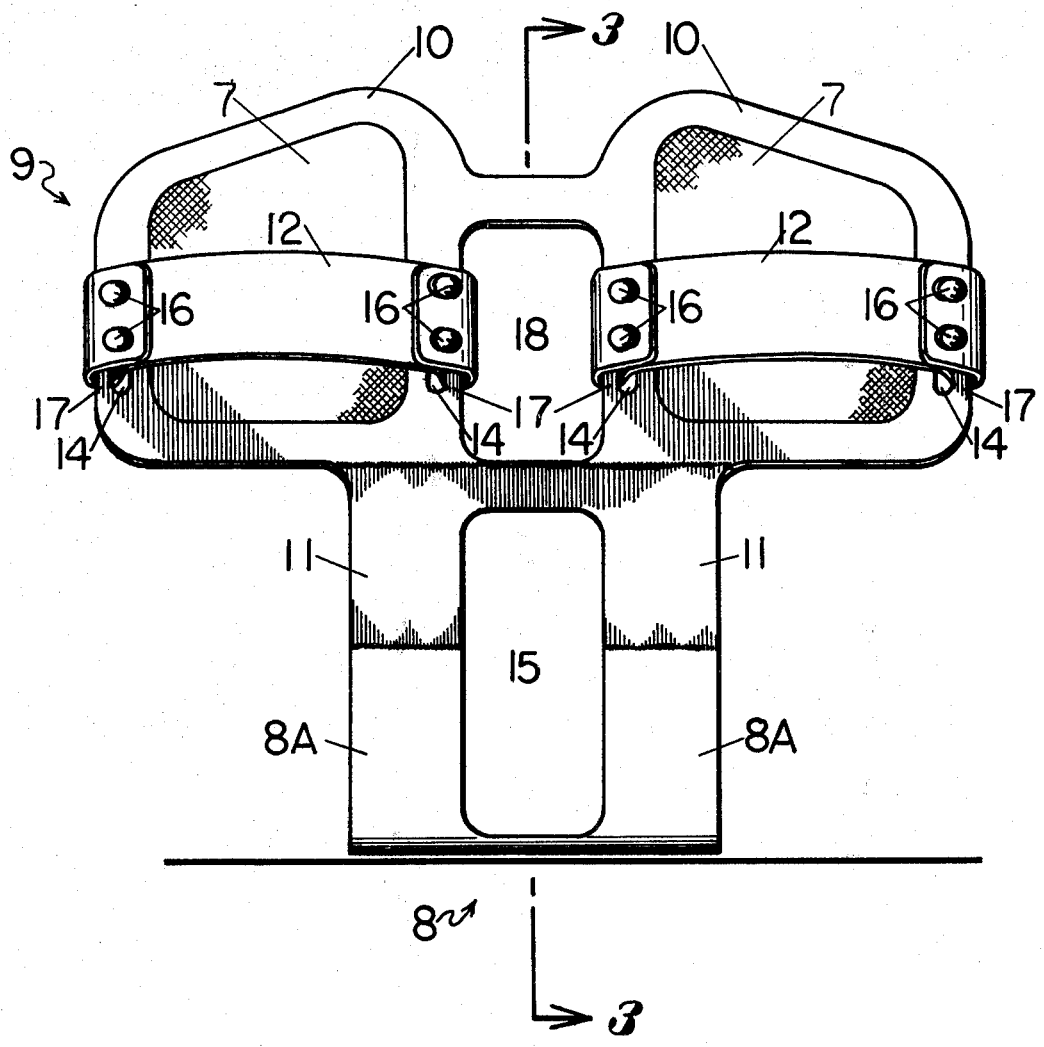
FIG. 1 is a front view of the foot-holding device.
Figure 2:
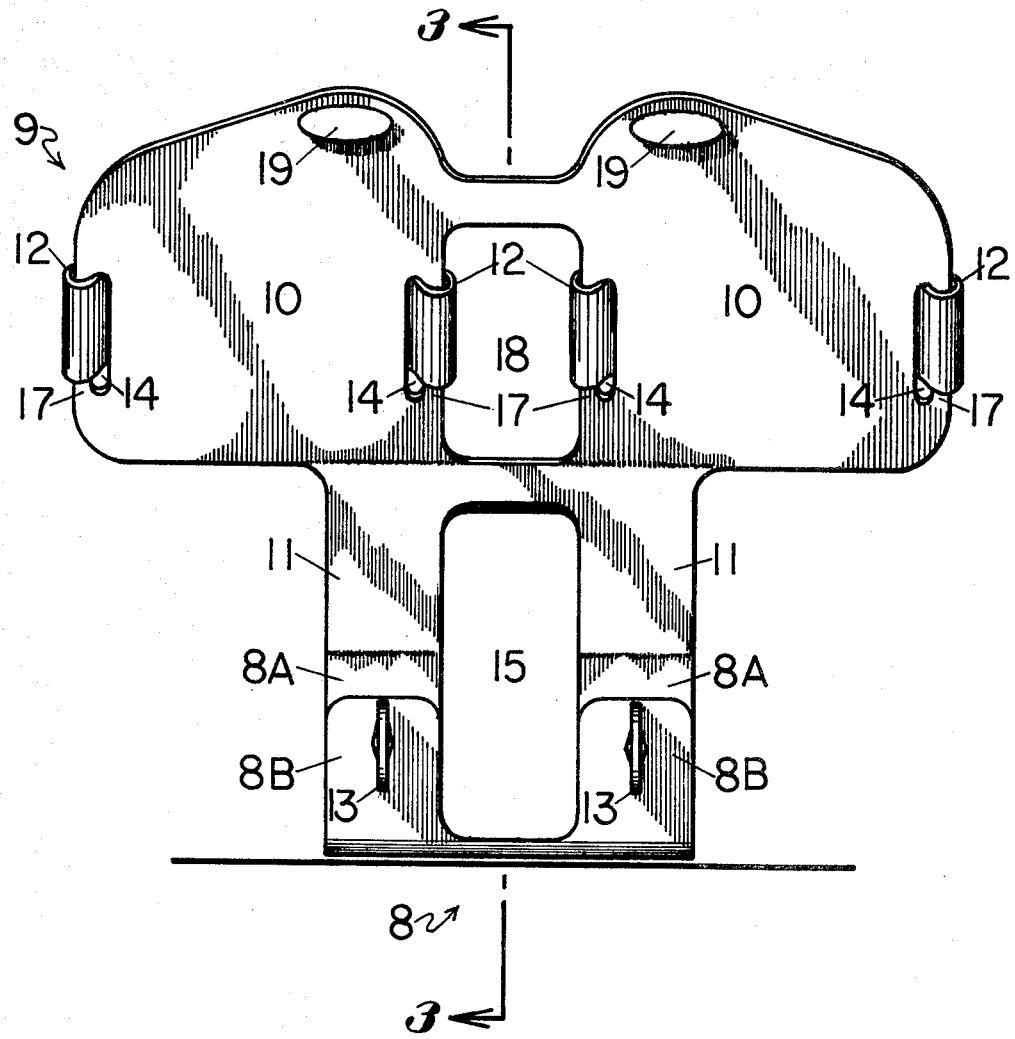
FIG. 2 is a rear view thereof.
Figure 3:
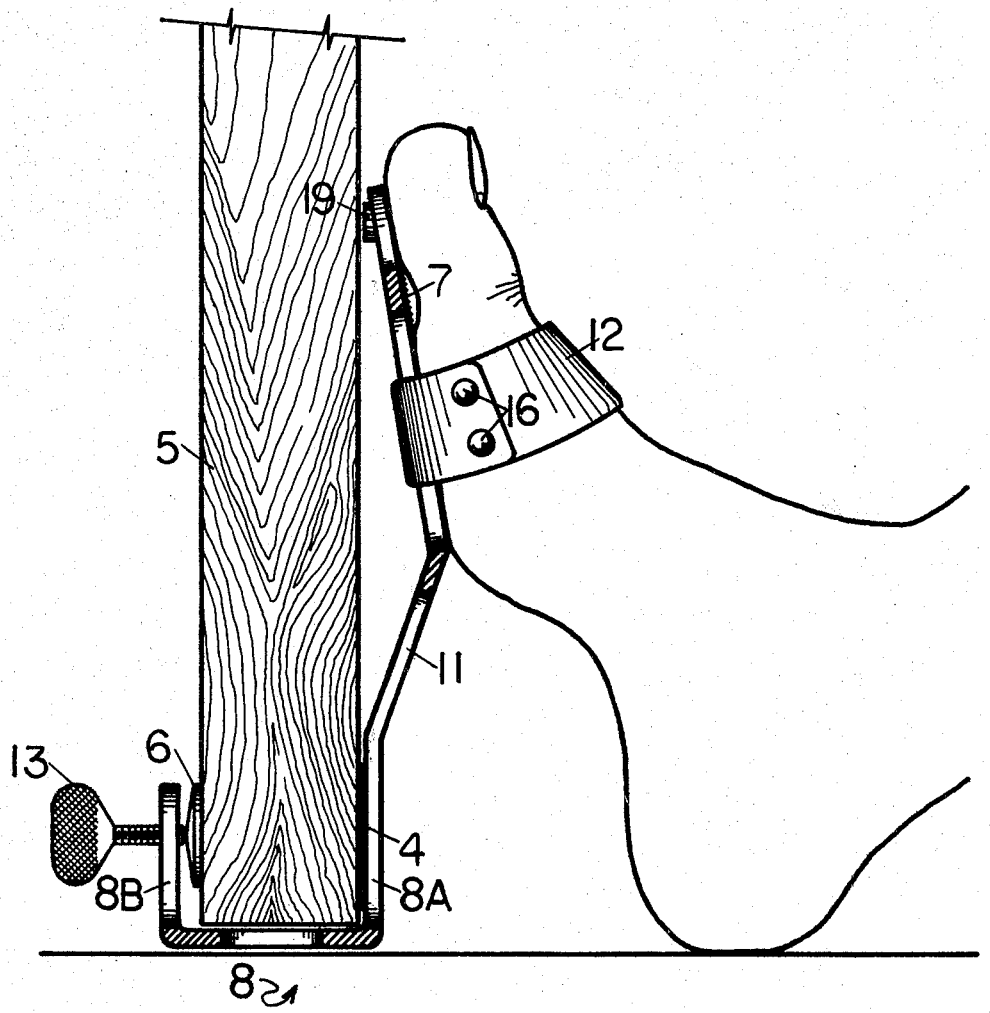
FIG. 3 is a section taken approximately along the indicated lines 3—3 of FIGS. 1 and 2.

The foot-holding, exercising device illustrated by the drawings includes a base, generally indicated at 8 and dimensioned to enable it to receive within it the bottom margin of a door 5 and to be slid therealong into a wanted position, the stock from which the device is formed being sufficiently thin to enable the door then to be closed.

The device has a foot-holding, head section, generally indicated at 9, and a connecting section 11, outwardly and upwardly inclined relative to the front wall 8A of the base to enable the head section 9 to be so spaced from the door 5 that it may be rearwardly and upwardly inclined, without contact therewith, its rearwardly inclined position ensuring proper support for the feet of the person when performing "sit-up", the angle of the head section 9 in the disclosed embodiment being about 10°.

As it is desirable that the base 8 be so dimensioned that it will freely receive the botton margin of any door and not damage the finish thereof while being installed or during use, the interior surface of the front wall 8A is provided with elastomeric cover 4 that are sufficiently soft for that purpose and preferably of the type that may be snap fitted into holes drilled in the front wall of the base 8. The rear wall is divided to provide spaced sections 8B each having a thumb screw 13 threaded therethrough with a rubber faced disc 6 held on its inner end.

The head section 9 is substantially wider than the other sections to provide laterally spaced supports 10, one for each foot of the user and dimensioned to be engaged by the ball area thereof and provided with a rubber cover 7, see FIG. 1. The head section 9 has a central cutout 18 and the side margins 17 of each support are slotted as at 14 to enable restraining straps 12 to be secured with ends inserted therethrough and folded back over the side margins and anchored to the straps as by rivets 16 with the straps 12 sufficiently loose to enable the user's feet to be easily slid in place and comfortably restrained thereunder.

As shown, it is preferred that the front wall 8A and the connecting section 11 have a common, central cutout 15 and it and the space between the base sections 8B are of the same width as the cutout 18.

Devices in accordance with the invention are preferably either formed from steel stampings or are of a cast aluminum construction. In either case, the cutouts minimize weight. In the event the stock used is such that it is slightly flexible, it is preferred that protective covers 19 be secured to the rear surface of each support 10 adjacent the upper edge thereof to ensure that the door to which a device is attached is not marred. The covers 19 may be of the same type as the covers 4 and attached in the same manner. The use of such covers is preferred to the use of stiffening ribs.

I claim:

1. A device for use in performing sit-up exercies, said device including a head means for receiving feet of a user, a pair of laterally spaced supports carried by said head means, one support for supporting each foot of a user, each support including a support surface engageable by the ball area of the foot during an exercise program and a restraining strap holding each foot to the support surface, a base section in the form of a U and shaped and dimensioned to receive within it the bottom margin of a door, a connecting section positioned between said head means and said one side wall of said U-shaped base section, said connecting section inclined outwardly and upwardly thus placing said supports in position to receive the feet of a person who is seated or lying on the floor while the sit-up exercises are being performed, and said head section being inclined relative to said connecting section towards a plane inclusive of said one side wall.

2. The device of claim 1 in which the head section is upwardly inclined toward a door when the device is attached thereto.

3. The device of claim 2 in which the angle of inclination of the head section with respect to a plane inclusive of said one side wall is in the approximate range of from 10° to 15°.

4. The device of claim 2 in which lock support is spaced to be out of contact with a door when the device is attached thereto.

5. The device of claim 2 in which each support includes yieldable covering means on its rear surface adjacent the upper edge of each support to prevent marring of a door during an exercise program.

* * * * *